US007018164B2

(12) United States Patent
Anthis et al.

(10) Patent No.: US 7,018,164 B2
(45) Date of Patent: Mar. 28, 2006

(54) AUXILIARY PIPE LOADING DEVICE

(75) Inventors: Roland Darrel Anthis, Mulhall, OK (US); Jason Scott Inglis, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 252 days.

(21) Appl. No.: 10/343,773

(22) PCT Filed: Sep. 6, 2001

(86) PCT No.: PCT/US01/28213

§ 371 (c)(1),
(2), (4) Date: Feb. 4, 2003

(87) PCT Pub. No.: WO02/20937

PCT Pub. Date: Mar. 14, 2002

(65) Prior Publication Data

US 2004/0022605 A1 Feb. 5, 2004

Related U.S. Application Data

(60) Provisional application No. 60/230,321, filed on Sep. 6, 2000.

(51) Int. Cl.
*B65G 59/06* (2006.01)

(52) U.S. Cl. ..... 414/797.7; 414/810; 221/95

(58) Field of Classification Search ..... 414/745.7, 414/786, 795.2, 797.9, 933, 810; 221/95, 221/252, 256, 266
See application file for complete search history.

(56) References Cited

U.S. PATENT DOCUMENTS

| | | | | |
|---|---|---|---|---|
| 3,095,048 | A * | 6/1963 | O'Neill et al. | 175/6 |
| 5,556,253 | A | 9/1996 | Rozendaal et al. | 414/797.7 |
| 5,607,280 | A | 3/1997 | Rozendaal | 414/745.7 |
| 6,085,852 | A * | 7/2000 | Sparks et al. | 175/52 |
| 6,179,065 | B1 * | 1/2001 | Payne et al. | 175/24 |
| 6,360,830 | B1 * | 3/2002 | Price | 175/52 |
| 6,474,931 | B1 * | 11/2002 | Austin et al. | 414/798.1 |

FOREIGN PATENT DOCUMENTS

DE 199 26 055 12/2000

* cited by examiner

*Primary Examiner*—Eileen D. Lillis
*Assistant Examiner*—Charles A. Fox
(74) *Attorney, Agent, or Firm*—Tomlinson & O'Connell, P.C.

(57) ABSTRACT

A pipe handling device with an auxiliary pipe loading device for use with a horizontal boring machine is disclosed. The auxiliary pipe loading device includes an auxiliary pipe receiving member that is connected to a pipe handling assembly at a location remote from the boring machine. The pipe receiving member is adapted to receive and support a pipe section when the pipe handling assembly is retracted such that the auxiliary pipe receiving member is positioned beyond the magazine of the pipe handling device. The auxiliary pipe receiving member is pivotally connected to a lockout assembly that is operable between a closed position and an open position. In the closed position, the lockout assembly prevents a pipe section from entering the auxiliary pipe receiving member. Whereas in the open position, the lockout assembly permits a pipe section to be manually placed in the auxiliary pipe receiving member. Additionally, an axial stop is provided as a mechanical guide for properly aligning the pipe section axially with the magazine.

45 Claims, 8 Drawing Sheets

AUXILIARY PIPE LOADING DEVICE

CROSS-REFERENCE TO RELATED APPLICATIONS

This application claims the benefit of International Application No. PCT/US01/28213, filed on Sept. 6, 2001, which claims the benefit of U.S. Provisional Application No. 60/230,321, filed on Sept. 6, 2000, the contents of which are incorporated fully herein by reference.

FIELD OF THE INVENTION

This invention relates to the handling of pipe for a horizontal boring device or other machine using or requiring the receipt of pipe in a generally horizontal position.

BACKGROUND OF THE INVENTION

In recent years, many utility lines have been laid or replaced by use of a horizontal boring or drilling machine which eliminates the need to dig a trench from the surface to install or replace the utility. This technique has generally come to be known as trenchless technology.

In a typical horizontal boring operation or a horizontal drilling operation, as it may alternatively be called, a bore hole is formed through the soil with a steerable bit connected to a drill string. The bore hole is commonly used to pull in a utility service such as an electric cable or a water line. The boring machine is mounted at the surface. One hydraulic motor on the boring machine causes the drill bit and drill string to rotate while another thrusts the drill bit and drill string forward as the bore is formed. It is also common to backream the bore with the machine, rotating a backreaming tool while drawing back the drill string to the boring machine.

The drill string is formed of a plurality of individual pipe sections threaded together. As the machine initially bores the hole, additional pipe sections must be added or "made up" as the bore is lengthened. The pipe sections are added from a magazine adapted to store a plurality of pipe sections. The pipe sections are transported from the magazine by a pipe handling device to the boring machine to form the drill string.

However, at times, while performing a bore with the boring machine, the magazine may be consumed such that all pipe sections will be used in the bore. When this occurs, a number of additional pipe sections may be required to complete the bore. One typical method for current pipe handling devices require that the empty magazine be removed from the drilling machine and another magazine with additional pipe sections be installed. This requires the use of additional equipment such as a tractor with a backhoe attachment to physically handle and replace the heavy magazine. This additional equipment is costly and may not be readily available at all times resulting in a delay in completing the job. Additionally, only a small number of additional pipe sections may be required to complete the bore, thus making it even less cost efficient to replace the entire magazine.

The invention of the U.S. Pat. No. 6,085,852 discloses a device that permits the operator to manually load and unload pipe sections without removing the magazine from the pipe handling device during boring and backreaming respectively. In this invention, the pipe holding mechanism of the pipe handling device is retracted to a position past the farthermost column of the magazine in order to manually load or unload pipe sections from the horizontal boring machine during boring and backreaming respectively. However, the device of U.S. Pat. No. 6,085,852 requires a large workspace area to provide for the retraction of the pipe holding mechanism beyond the farthermost column of the magazine.

The present invention provides a mechanism for adding and removing additional pipe sections from the horizontal boring machine in a compact work space. Additionally, the present invention provides a simple mechanism to easily manually load or unload an individual pipe section to or from the magazine, using the pipe handling assembly. In the case of adding a pipe section, the pipe section may be added to an empty magazine or to a selected magazine column using the present inventive device. The boring machine operator can then operate the pipe handling device to deliver the added pipe section to the drilling machine. Yet, at other times it may be desirable to remove a particular pipe section from the drill string. This can be accomplished in a cost effective manner using the present invention and without emptying the entire magazine as will be discussed. The present invention may be used with a pipe handling system such as that disclosed in U.S. Pat. No. 6,085,852, entitled Pipe Handling Device and issued Jul. 11, 2000, the contents of which are incorporated herein by reference.

SUMMARY OF THE INVENTION

In one aspect, the invention is directed to a pipe handling assembly for use with a horizontal boring machine and a magazine. The magazine has an outer border remote from a spindle axis of the horizontal boring machine, and a lower portion that has a discharge outlet formed therein.

The pipe handling assembly comprises a pipe transfer member and an auxiliary pipe receiving assembly. The pipe transfer member is adapted to transport a pipe section between spindle axis and the discharge outlet of the magazine. The auxiliary pipe receiving assembly is operatively connectable to the pipe transfer member and is adapted to transport a pipe section between the discharge outlet of the magazine and an auxiliary area beyond the outer border of the magazine.

In another aspect, the invention is directed to a horizontal boring machine system to operate a variable length drill string that is made up of a plurality of pipe sections. The horizontal boring machine system comprises a boring machine and a pipe handling assembly. The boring machine has a spindle defining a spindle axis. The pipe handling assembly has a magazine, a pipe transfer member, and an auxiliary pipe receiving assembly. The pipe handling assembly is adapted to add and remove pipe sections to and from the drill string.

The magazine defines an outer border remote from the spindle axis and has at least one discharge opening through which the pipe sections are released. The pipe transfer member is adapted to transport a pipe section between the spindle axis and the discharge opening of the magazine. Further, the auxiliary pipe receiving assembly is operatively connectable to the pipe transfer member and is adapted to transport a pipe section between the discharge opening of the magazine and an auxiliary area beyond the outer border of the magazine.

In still another aspect, the invention is directed to a method for adding pipe sections to makeup a drill string that is composed of a plurality of pipe sections. The method is performed using a horizontal boring machine with a spindle axis, and a pipe handling assembly with a pipe transfer member, to form a horizontal borehole.

The method comprises transporting a pipe section to a magazine of the pipe handling assembly from an auxiliary pipe receiving area beyond an outer border of the magazine remote from the spindle axis, with an auxiliary pipe receiving assembly operatively connectable to the pipe transfer member between a first end proximate the spindle axis, and a second end distal from the spindle axis, of the pipe transfer member. The pipe section is then transported from the magazine to the spindle axis using a pipe holding member operatively connectable to the first end of the pipe transfer member.

The invention is further directed to a method for removing pipe sections to breakout a drill string that is composed of a plurality the pipe sections. The method is performed using a horizontal boring system comprising a horizontal boring machine with a spindle axis, and a pipe handling assembly with a pipe transfer member.

The method comprises transporting a pipe section that is removed from the drill string at the spindle axis is transported to a selected magazine column of the pipe handling assembly by a pipe holding member that is operatively connectable to a first end of the pipe transfer member proximate to the spindle axis. The removed pipe section is then transported from the selected magazine column to an auxiliary pipe receiving area beyond an outer border of the magazine remote from the spindle axis using an auxiliary pipe receiving assembly operatively connectable to the pipe transfer member between the first end and a second end of the pipe transfer member.

BRIEF DESCRIPTION OF THE DRAWINGS

FIG. 9 is a side view of a pipe handling device with a boring machine in accordance with the present invention.

DETAILED DESCRIPTION OF THE PREFERRED EMBODIMENTS

Figure 1:
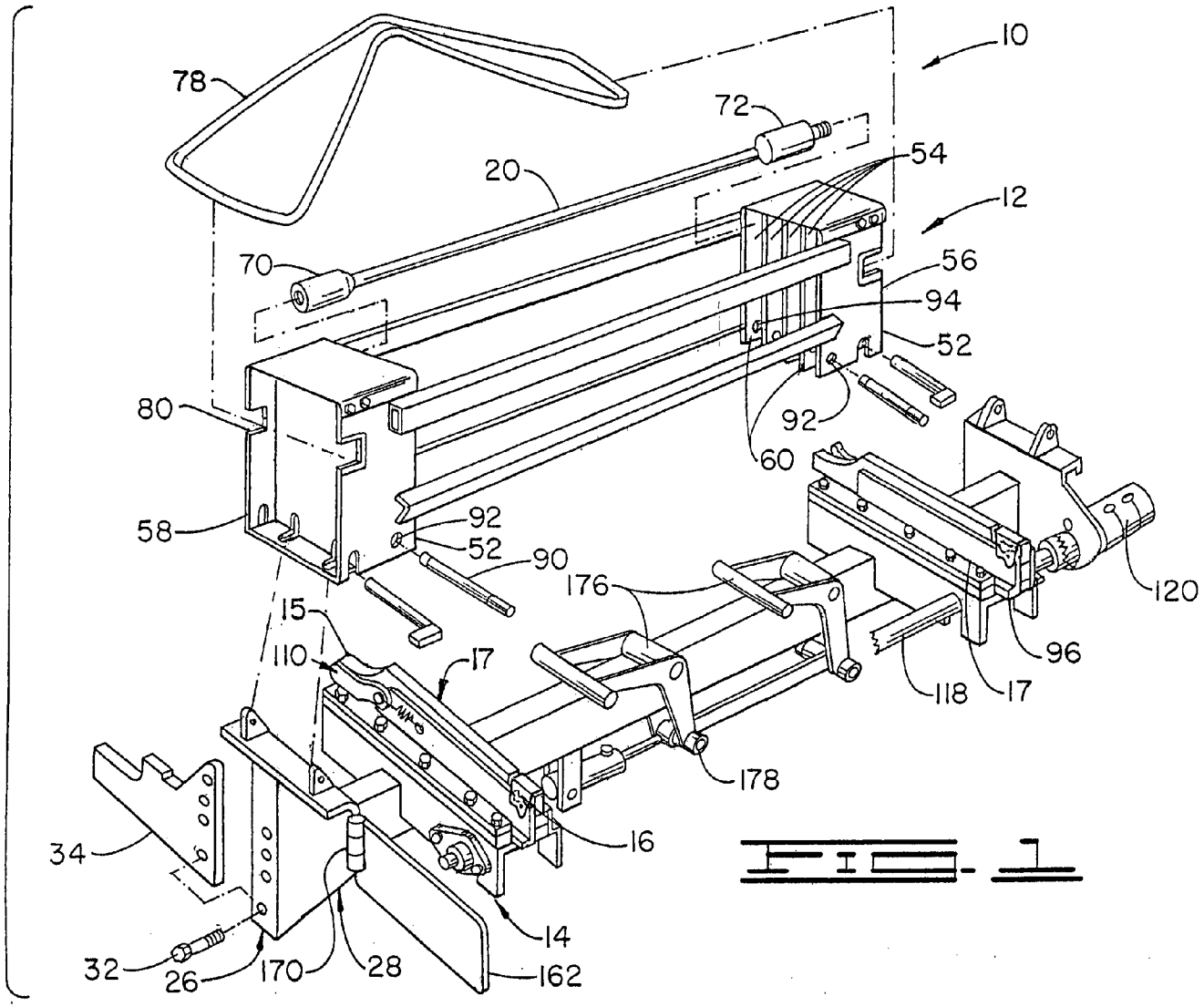
FIG. 1 is an exploded perspective view of a preferred embodiment of the pipe handling assembly with the auxiliary pipe receiving assembly of the present invention.
Figure 2:
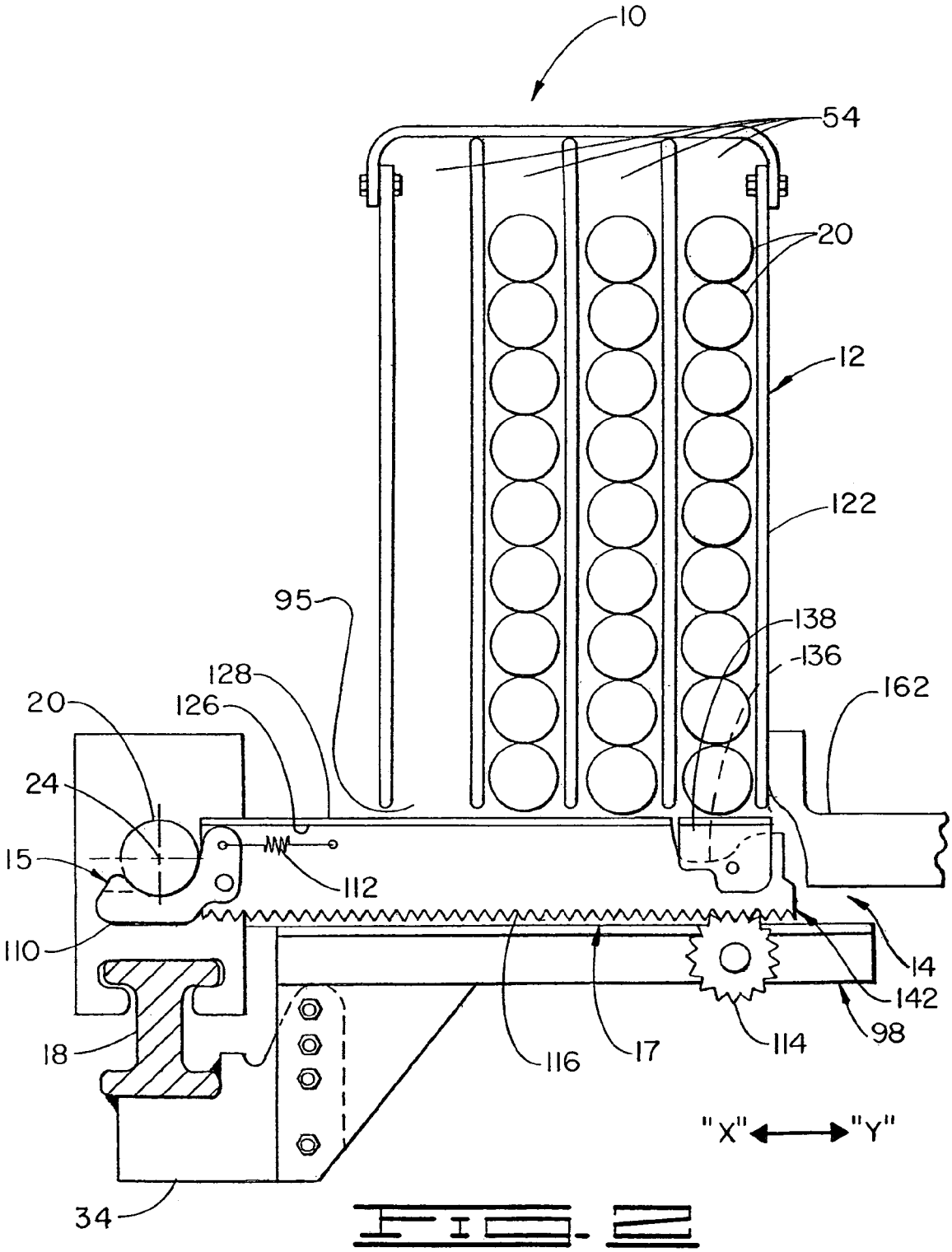
FIG. 2 is a partly cross-sectional end view of the pipe handling assembly of FIG. 1 illustrating the auxiliary pipe receiving assembly at the magazine position.

Turning now to the drawings in general and to FIGS. 1, 2, 3, 8 and 9 in particular, there is shown therein a preferred pipe handling device with an auxiliary pipe receiving assembly in accordance with the present invention. The pipe handling device is adaptable for use with any machine or equipment requiring the use or receipt of elongate objects in a generally horizontal position. In the preferred embodiment, the pipe handling device, designated generally by the reference numeral 10, comprises a magazine 12 and a pipe handling assembly 14. The pipe handling assembly 14 in turn comprises a primary pipe receiving assembly comprising a pipe holding member 15, an auxiliary pipe receiving assembly 16 and a pipe transfer member 17 as will be described in detail later. The pipe handling device 10 may be positioned adjacent the frame of a horizontal boring machine 18, as illustrated in FIG. 2, for storing and laterally transporting pipe sections 20 between the pipe handling device and the horizontal boring machine. The pipe handling device 10 is adapted to shuttle pipe sections, 20 between an auxiliary pipe receiving area 22 (FIG. 3) and a spindle axis 24 of the horizontal boring machine 18 in a generally horizontal position in a manner yet to be described.

With continued reference to FIGS. 1, 2, 3 and 9 in the preferred embodiment, the pipe handling assembly 10 is adapted to be mounted to the horizontal boring machine 18 via a mounting assembly 26. The mounting assembly 26 facilitates accurate alignment of pipe sections 20 with the horizontal boring machine 18 and removably connects a frame 28 of the pipe handling assembly 10 to the horizontal boring machine. It may be noted that in the preferred embodiment, fasteners 32 are used to removably connect the pipe handling assembly 10 with the horizontal boring machine 18 and with an adapter 34 to allow accurate alignment of the pipe handling assembly with the spindle axis 24. However, any other mechanism that will permit the proper alignment of the pipe handling assembly 10 with the spindle axis 24 may be used.

In the preferred embodiment as illustrated in FIGS. 1–9, the magazine 12 stores a plurality of pipe sections 20 in a manner yet to be described. The pipe transfer member 17 comprises a pipe holding member 15 to receive pipe sections 20 from the magazine 12 and transport the pipe sections to the spindle axis 24 of the horizontal boring machine 18 in a manner yet to be described. Additionally, the auxiliary pipe receiving assembly 16 operates in conjunction with the pipe holding member 15 to supply additional pipe sections 20 from the auxiliary pipe receiving area 22 to the spindle axis 24 in a manner yet to be described.

With reference now to FIGS. 1 and 2, preferably, the magazine 12 is situated directly above the frame 28 and is removably connectable therewith. The magazine 12 preferably defines a lower portion 52 and a plurality of pipe receiving columns 54. This configuration accommodates a plurality of pipe sections 20 which may be stacked in columns of generally horizontal pipe inside the magazine 12. The columns 54 preferably are formed by a pair of opposing ends 56 and 58 defining a plurality of vertical storage structures 60. The vertical storage structures 60 in the opposing ends 56 and 58 correspond to create tracks for receiving the ends 70 and 72 of a pipe section 20 as shown in FIG. 1. The number of columns 54 in the magazine 12 is dependent upon the number of vertical storage structures 60 formed in the opposing ends 56 and 58.

Figure 6:
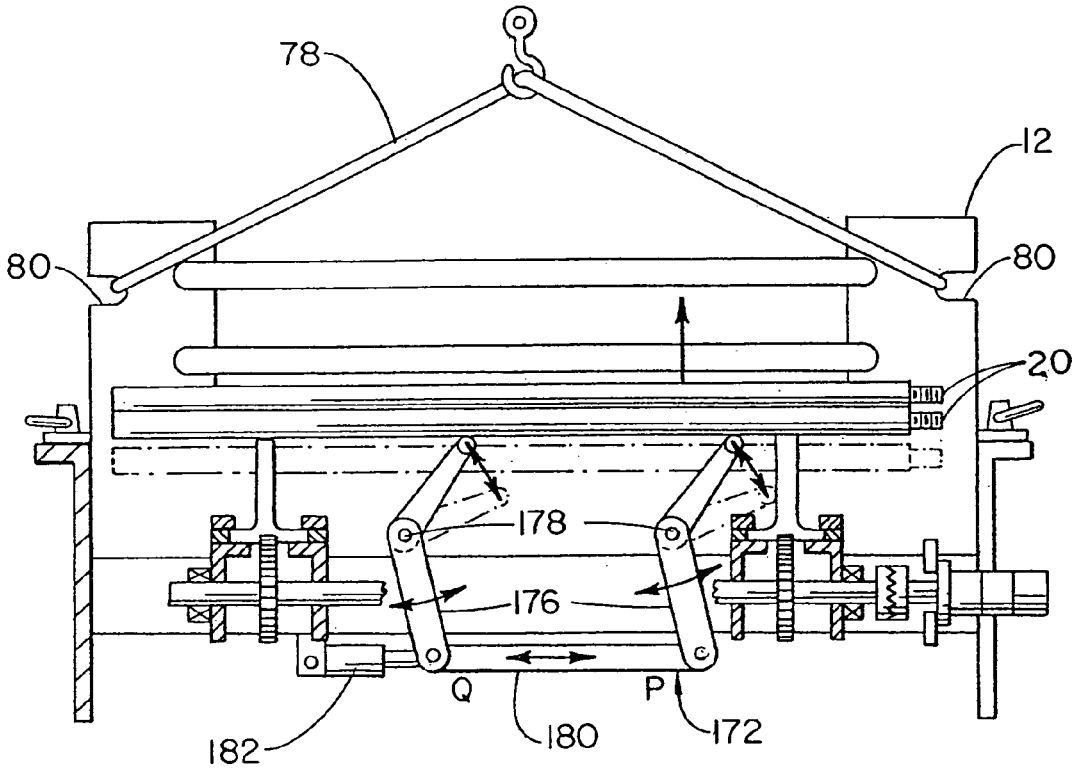
FIG. 6 is a side elevational view of the pipe handling assembly of FIG. 1 showing the operation of the pipe return assembly.

With reference to FIGS. 1 and 6, preferably, the magazine 12 may further comprise a sling-type lift 78. In the preferred embodiment, the opposing ends 56 and 58 comprise a plurality of recesses 80 adapted to receive the lift 78. The lift 78 permits the magazine 12 to be lifted and transported. Thus, it will now be appreciated that the magazine 12 is removable and transportable, while the frame 28 remains in an aligned position with respect to the spindle axis 24 of the horizontal boring machine 18.

With reference to FIG. 1, in the preferred embodiment, the magazine 12 may be removed from the frame 28 while either empty or loaded with pipe sections 20. If removed while loaded, pipe sections 20 may be prevented from falling out of the magazine 12 through the open bottom 52 by retaining pin 150*s* 90. Retaining pin 150*s* 90 are received through apertures 92 and 94 formed in the opposing ends 56 and 58.

It will now be appreciated that the magazine 12 efficiently stores pipe sections 20 in generally vertical columns 54 and that the pipe sections are accessible through the lower portion 52 of the magazine that defines at least one discharge opening 95 (FIGS. 2–3) that permits the pipe sections 20 to be loaded and unloaded to and from the magazine in a manner yet to be described.

Figure 3:
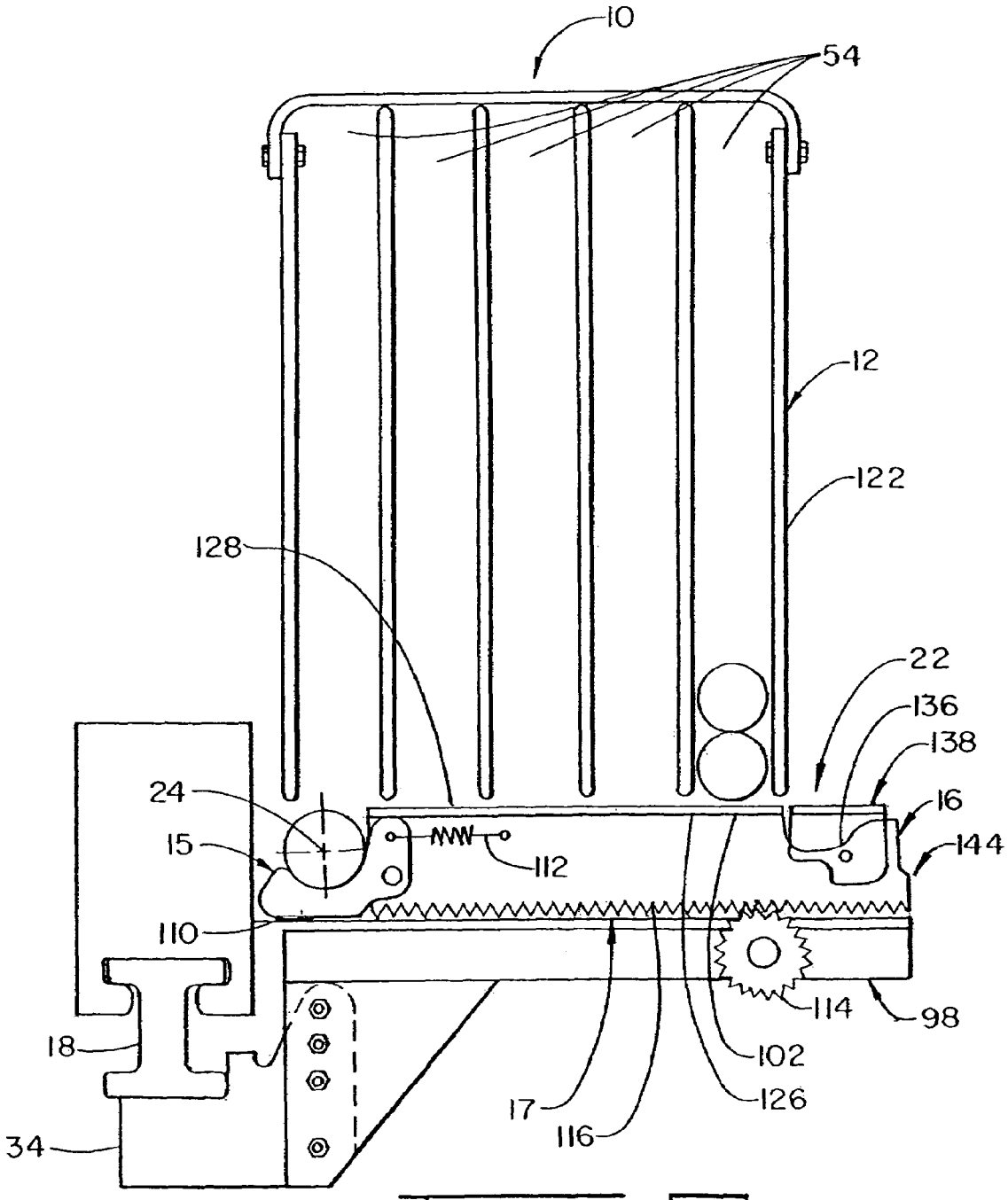
FIG. 3 is a partly cross-sectional end view of the pipe handling assembly of FIG. 1 illustrating the auxiliary pipe receiving assembly at the auxiliary pipe receiving position.
Figure 5:
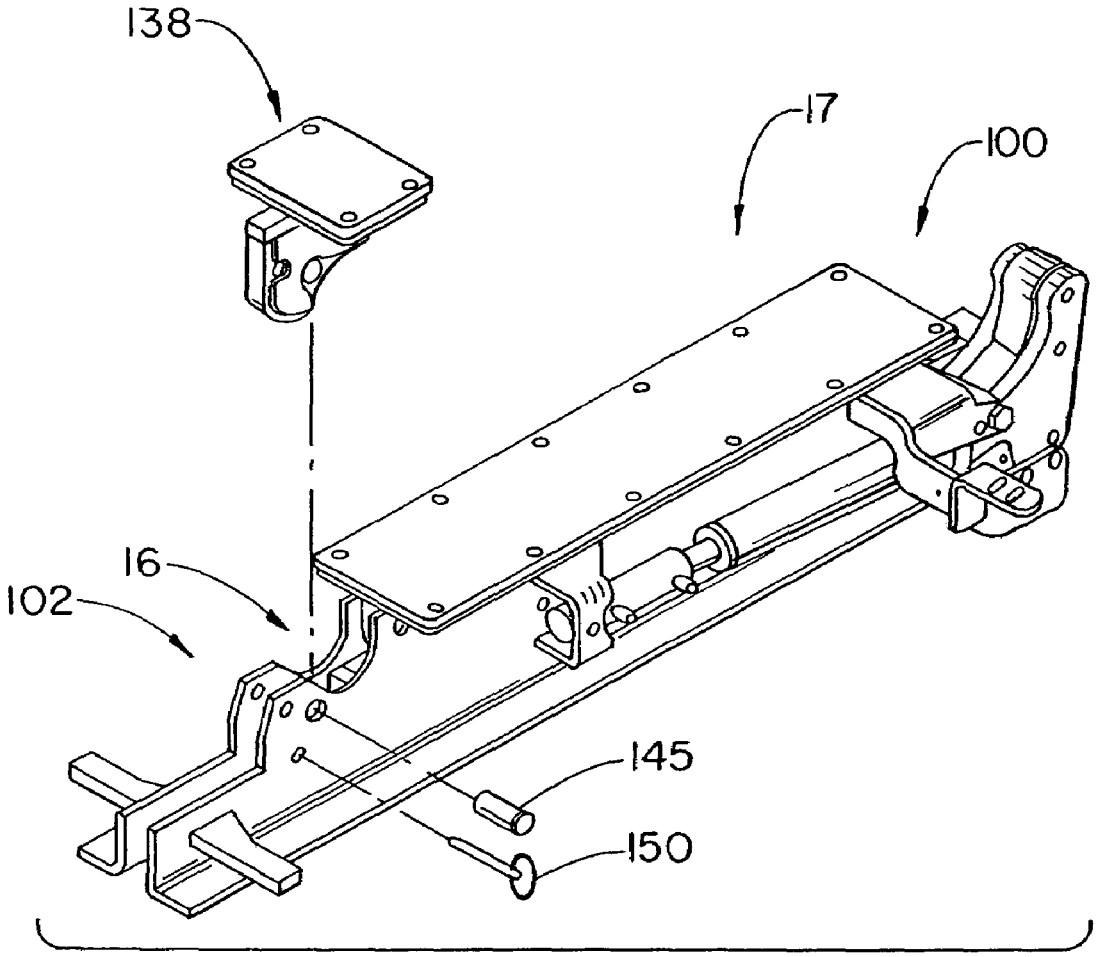
FIG. 5 is an exploded view of the lockout system and the transfer arm of the present invention.
Figure 8:
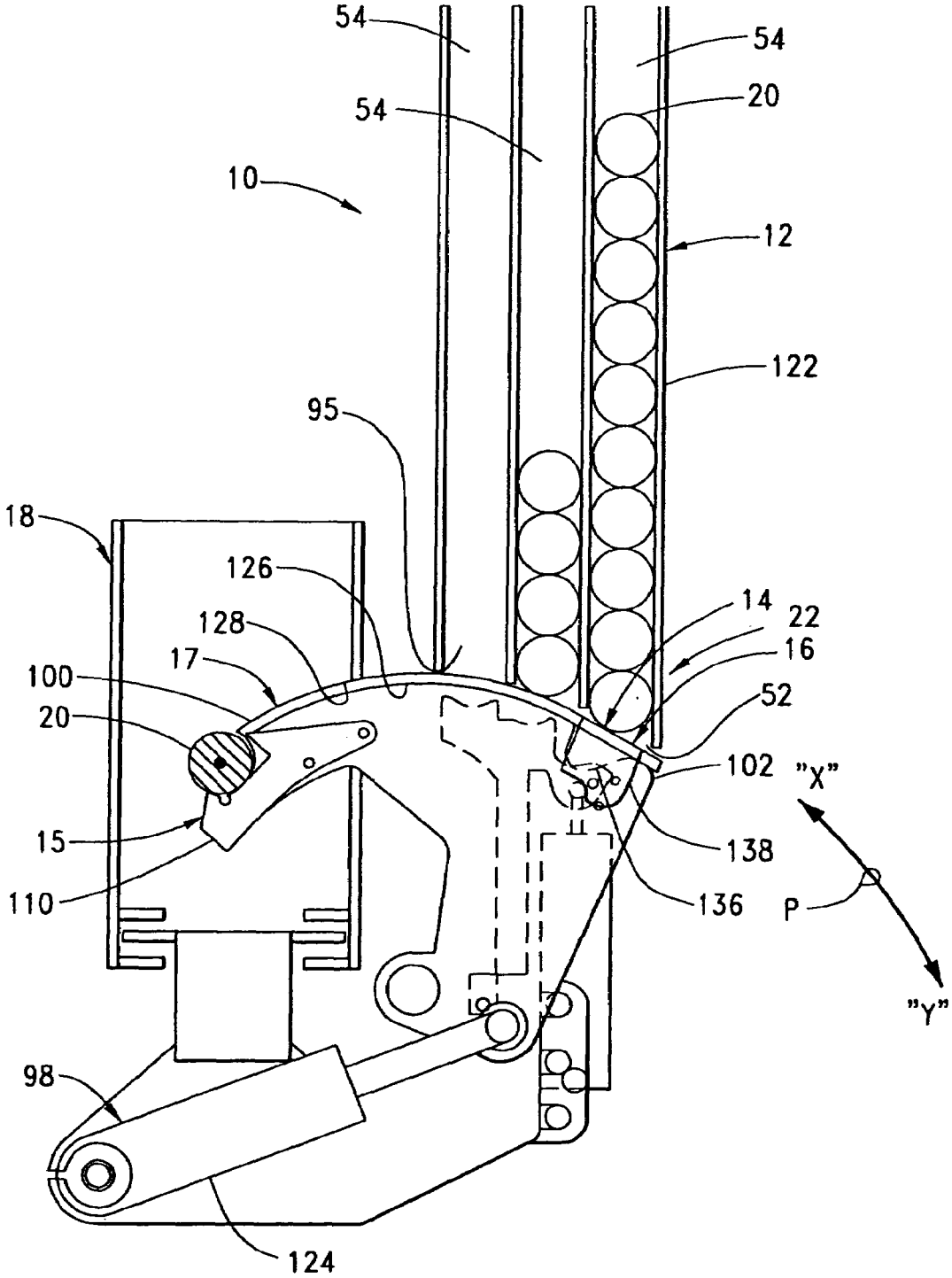
FIG. 8 is a partly cross-sectional end view of a pipe handling assembly with an arcuate shaped pipe transfer member with the auxiliary pipe receiving assembly of the present invention.
Figure 8:
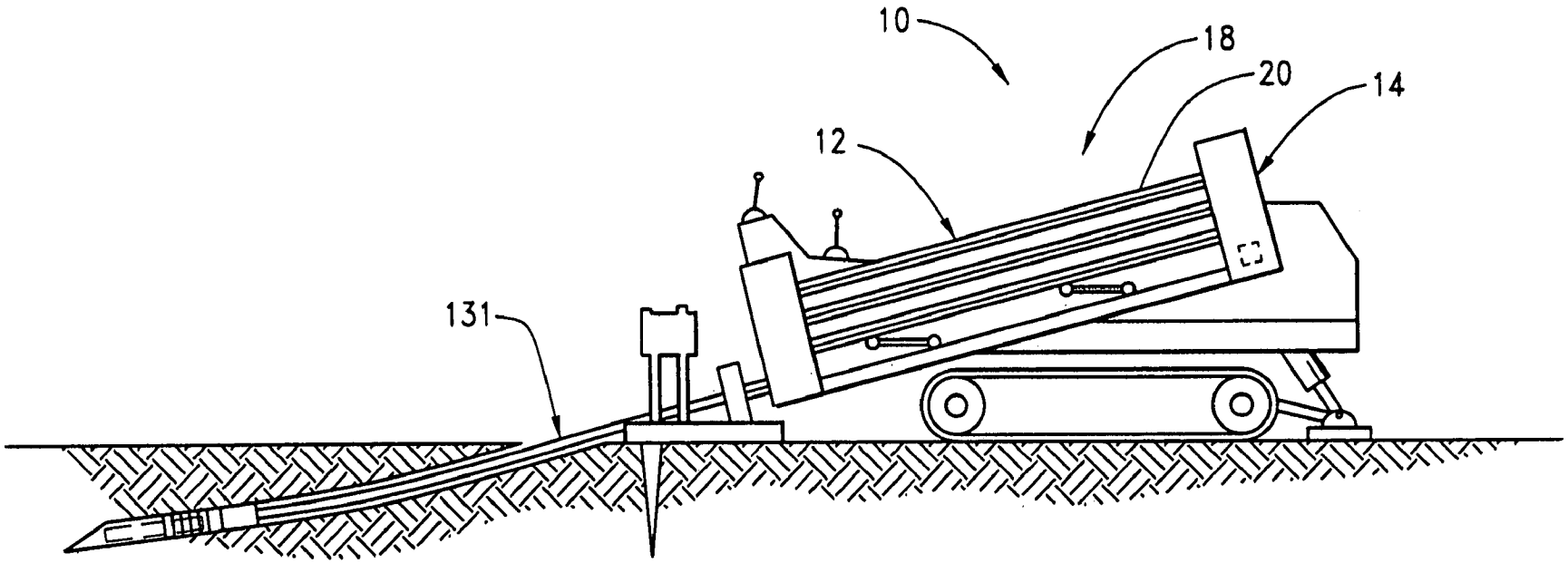

As illustrated in FIGS. 1, 2 and 5 in the preferred embodiment, the pipe transfer member 17 is situated directly beneath the lower portion 52 of the magazine 12. The pipe transfer member 17 is movably supported on the frame 28. The pipe transfer member 17 uses a drive assembly 98 for driving the movement of the pipe transfer member, the pipe holding member 15 and the auxiliary pipe receiving assembly 16. The drive assembly 98 drives the movement of the pipe transfer member 17 on a delivery path between the spindle axis 24 and the auxiliary pipe receiving area 22 as illustrated in FIGS. 3 and 8. The pipe transfer member 17 may be planer, arcuate, or any other shape that can still permit the pipe transfer member to function as below. The pipe transfer member 17 comprises a first end 100 and a second end 102 remote from the spindle axis 24. The first end 100 of the pipe transfer member 17 is operatively connectable to the pipe holding member 15 that is structurally linked to the pipe transfer member in a manner yet to be described. The pipe holding member 15 is linked to the pipe transfer member 17 at a location proximal to the horizontal boring machine 18. The pipe holding member 15 is adapted to receive and support a pipe section 20 in order to transport the pipe section between the discharge opening 95 of the magazine and the spindle axis 24 of the horizontal boring machine 18. The pipe holding member 15 may further comprise a retaining structure 110 for retaining a pipe section 20 in the pipe holding member. In the preferred embodiment, each retaining structure 110 comprises a spring loaded pipe retainer operatively connected to the pipe transfer member 17 via a spring 112. Retaining structure 110 retains the pipe section 20 in the pipe holding member 15 until the pipe section 20 is aligned with the spindle axis 24. It will be appreciated that other retaining structures 110 such as a hydraulic gripper may also be used.

In the preferred embodiment, as illustrated in FIGS. 1–3, two pipe transfer members 17 are positioned on the frame 28 in a manner generally parallel with each other. The pipe transfer members 17 are advanced and retracted laterally and generally perpendicular to the spindle axis 24 of the horizontal boring machine 18 in such a manner as to shuttle pipe sections 20 between the horizontal boring machine and beyond the magazine 12 to the auxiliary pipe receiving area 22. The extension and retraction of the pipe transfer member 17 is powered by the drive assembly 98.

The drive assembly 98, illustrated in FIGS. 1–3 preferably comprises rack and pinion gear assemblies mounted on the frame 28. The rack and pinion gear assembly is operatively connected to each pipe transfer member 17 and comprises a pinion gear 114 and a gear rack 116. The rack 116 and pinion 114 gears are mounted parallel on a shaft 118 which is rotated by a hydraulic motor 120.

In the preferred embodiment, the shaft 118 is mounted on the frame 28 generally parallel to the spindle axis 24 of the horizontal boring machine 18. The shaft 118 is rotated by the hydraulic motor 120 mounted at one end of the frame 28 (see FIG. 1). The pinion gears 114 are mounted in parallel on the shaft 118 beneath the pipe transfer member 17. Gear racks 116 are welded to the pipe transfer members 17.

Preferably, operation of the hydraulic motor 120 rotates the shaft 118, which in turn causes the pinion gears 114 to rotate. As shown in FIG. 2, the rotating pinion gears 114 engage the gears racks 116. When the pinion gears 114 rotate in a counterclockwise direction, the pipe transfer members 17 extend laterally in the direction of the horizontal boring machine 18, designated in FIG. 2 as direction X, thereby transporting a pipe section 20 to the spindle axis 24. The pinion gears 114 may be rotated in a clockwise direction to cause the pipe holding member 104 to retract in direction Y (FIG. 3), to enable return of a pipe section 20 to the magazine 12. Additionally, the pinion gears 114 may be rotated further in a clockwise direction to cause the second end 102 of the pipe transfer member 17 to retract to the auxiliary pipe receiving area 22 beyond an outer border 122 of the magazine column 54 farthermost from the spindle axis 24 as illustrated in FIG. 3 for reasons that will become obvious later.

It may be noted that any other drive assembly 98 that is capable of extending and retracting the pipe transfer member 17 may be employed. For example, a hydraulic cylinder 124 as illustrated in FIG. 8 to drive the pipe transfer member 17 between the spindle axis 24 and the auxiliary pipe receiving area 22 may be used.

With reference to FIGS. 2 and 3, in the preferred embodiment, the pipe transfer members 17 comprise a pipe blocking member 126 between the first end 100 and the second end 102 of the pipe transfer member. The pipe blocking member 126 has an oversurface 128 that contacts with the pipe sections 20 at the lower portion of the magazine 12 and selectively blocks the discharge of the pipe sections from the magazine columns 54. The oversurface 128 may have a wear protection coating in order to prevent excessive wear of the oversurface.

Figure 7:
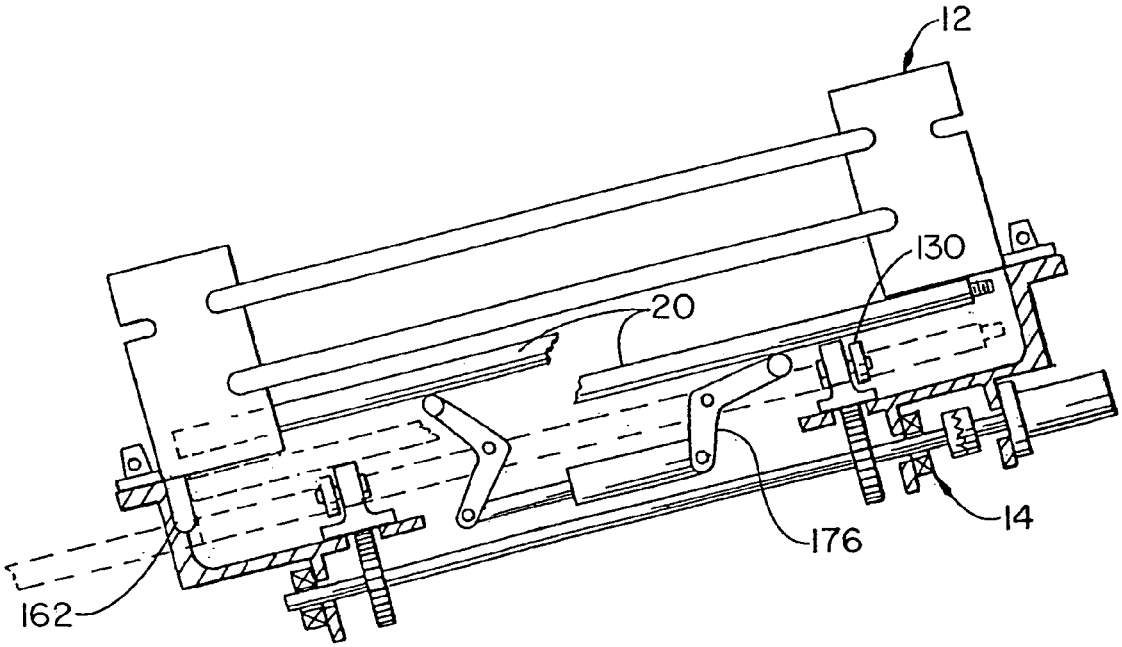
FIG. 7 is a side elevational view of the pipe handling assembly of FIG. 1 showing the placement of rollers for preventing axial sliding of pipe sections during transport between the spindle axis and the magazine.

In the preferred embodiment, the pipe handling assembly 14 preferably further comprises rollers 130, as shown in FIG. 7, to reduce axial sliding of the pipe section 20 while positioned in the pipe holding member 15. When in a normal operating position, the spindle axis 24 is at an angle of approximately ten to twenty degrees with respect to the ground. The pipe handling assembly 10 is aligned with the spindle axis 24 of the horizontal boring machine 18. Consequently, pipe sections 20 are delivered to and from the spindle axis 24 on an inclined plane. At this angle, pipe sections 20 may slide axially in the pipe holding members 15. The rollers 130 are preferably comprised of a resilient compound which creates a frictional force with the pipe section 20 in the pipe holding member 15, thus creating resistance to slippage. The rollers 130 allow rotation of the pipe section 20, which is necessary to connect and disconnect the pipe from the horizontal boring machine 18, yet offer resistance to axial sliding due to their composition. However, it may be noted that any other device that reduces axial sliding of a pipe section 20 in the pipe holding member 15 may be used in place of the rollers 130.

Turning now to FIGS. 2 and 3, it will be noted that to receive a pipe section 20 from the magazine 12, the transfer members 17 of the pipe handling assembly 10 are retracted to position the pipe holding member 15 beneath the selected column 54 from which a pipe is to be received. Generally, pipe sections 20 first will be retrieved from the column 54 proximal the horizontal boring machine 18 until this column is empty. Thereafter, pipe sections 20 will be retrieved from the immediately adjacent column 54 until it also is empty. Retrieval of pipe sections 20 will proceed in the same fashion until all columns 54 are empty or until the boring operation is completed.

In the preferred embodiment, after selecting the desired column 54, the pipe transfer members 17 are retracted to position the pipe holding member 15 beneath the selected column. The pipe transfer members 17 are advanced in direction Y by the gear racks 116 and the pinion gears 114. As the pipe holding member 15 is positioned beneath the desired column 54, gravity causes the pipe section 20 positioned at the discharge opening 95 of the selected column to fall into the pipe holding member 15. The retaining structure 110 is supported by the drive assembly 98 while the pipe transfer members 17 are in the retracted position beneath the selected column 54. The retaining structure 110 prevents the pipe section 20 from rolling off of the pipe holding member 15.

Preferably, the pipe transfer members 17 are advanced to the spindle axis 24 for connection of the pipe section 20 in the pipe holding member 15 with a drill string 131 (FIG. 9) of the horizontal boring machine 18. The horizontal boring machine 18 is then operated to connect the pipe section 20 to the drill string 131 on the horizontal boring machine. Boring operations may then resume and the above procedure is repeated until all the pipe sections 20 from the magazine 12 have been added to the drill string 131. At this point if only a single pipe section 20, or a few additional pipe sections 20 are required to be added to the drill string 131, the operator will, instead of adding a new magazine, employ the auxiliary pipe receiving assembly 16 to add the additional required pipe section to the drill string 131 from the auxiliary pipe receiving area 22.

With reference now to FIGS. 2 through 4, there is illustrated a preferred embodiment of the auxiliary pipe receiving assembly 16. In the preferred embodiment, the auxiliary pipe receiving assembly 16 is operably connectable to the pipe transfer member 17 between the first end 100 and the second end 102 of the pipe transfer member. The auxiliary pipe receiving assembly 16 is adapted to transport a pipe section 20 on a delivery path between a magazine position 142 (FIG. 2) and an auxiliary position 144 (FIG. 3) wherein the delivery path comprises at least one straight line segment. In the magazine position 142 the auxiliary pipe receiving assembly 16 is positionable at the discharge opening 95 of the magazine column 54 to load and unload a pipe section 20 to and from the magazine column. In the auxiliary position 144, the auxiliary pipe receiving assembly 16 is positionable beyond the outer border 122 of the magazine 12 remote from the spindle axis to load and unload a pipe section 20 to and from the auxiliary pipe receiving area 22. The auxiliary pipe receiving assembly 16, preferably comprises a pipe receiving chamber 136, and a lockout system 138 operatively connectable to the pipe receiving chamber as will be discussed herein.

The auxiliary pipe receiving assembly 16 is designed to allow additional pipes to be more easily added when pipe columns 54 are empty of pipe sections 20 and additional pipe sections are required to complete the bore. Typically, additional pipe sections 20 are added to the outermost column 54 of the magazine 12 that is farthest away from the spindle axis 24. However, alternative designs could be employed that include other pipe columns 54 to add the additional pipe sections 20 to the interior of the magazine 12.

Preferably, the pipe receiving chamber 136 of the auxiliary pipe receiving assembly 16 is typically formed by moving the auxiliary pipe receiving assembly and is adapted to receive and support a pipe section 20. In the preferred embodiment, the pipe receiving chamber 136 is a notch or trough shaped opening operatively connectable to the pipe transfer member 17 at a position anywhere on the pipe transfer member 17 between the first end 100 and the second end 102. Alternatively, the pipe receiving chamber 136 may be positionable at the second end 102 of the pipe transfer member 17. The pipe receiving chamber 136 is designed such that the pipe receiving chamber will align with at least one column of pipe 54 within the magazine 12. In the preferred embodiment, the pipe receiving chamber 136 is adapted to receive and support a pipe section 20 when alignment occurs between the receiving chamber 136 and one of the columns 54. It may be noted that in the preferred embodiment, the auxiliary pipe receiving assembly 16 is typically used when the pipe transfer member 17 are moved farthest away from spindle axis 24 so that the pipe receiving chamber 136 of the auxiliary pipe receiving assembly is positioned beyond the outer border 122 of the farthermost magazine column 54 from the spindle axis to the auxiliary pipe receiving area 22 as shown in FIG. 3.

Figure 4A:
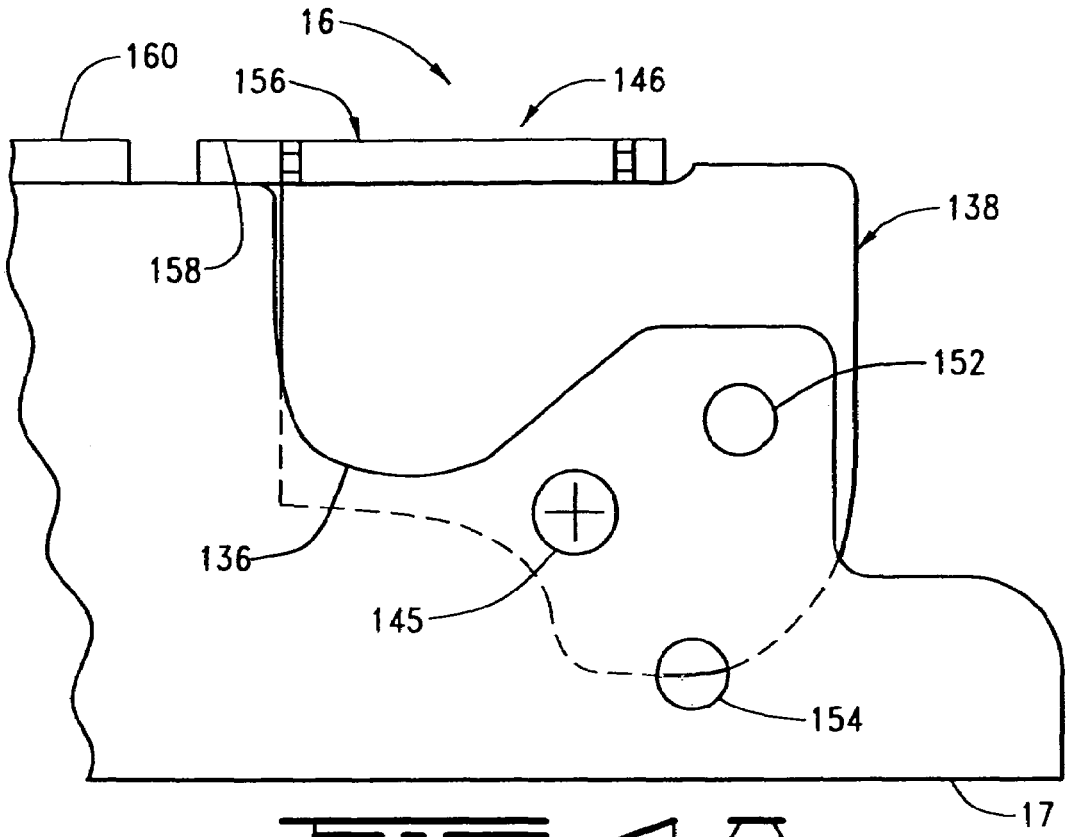
FIG. 4*a* is a fragmented, end view of the auxiliary pipe receiving assembly with the lockout system in the closed position.
Figure 4B:
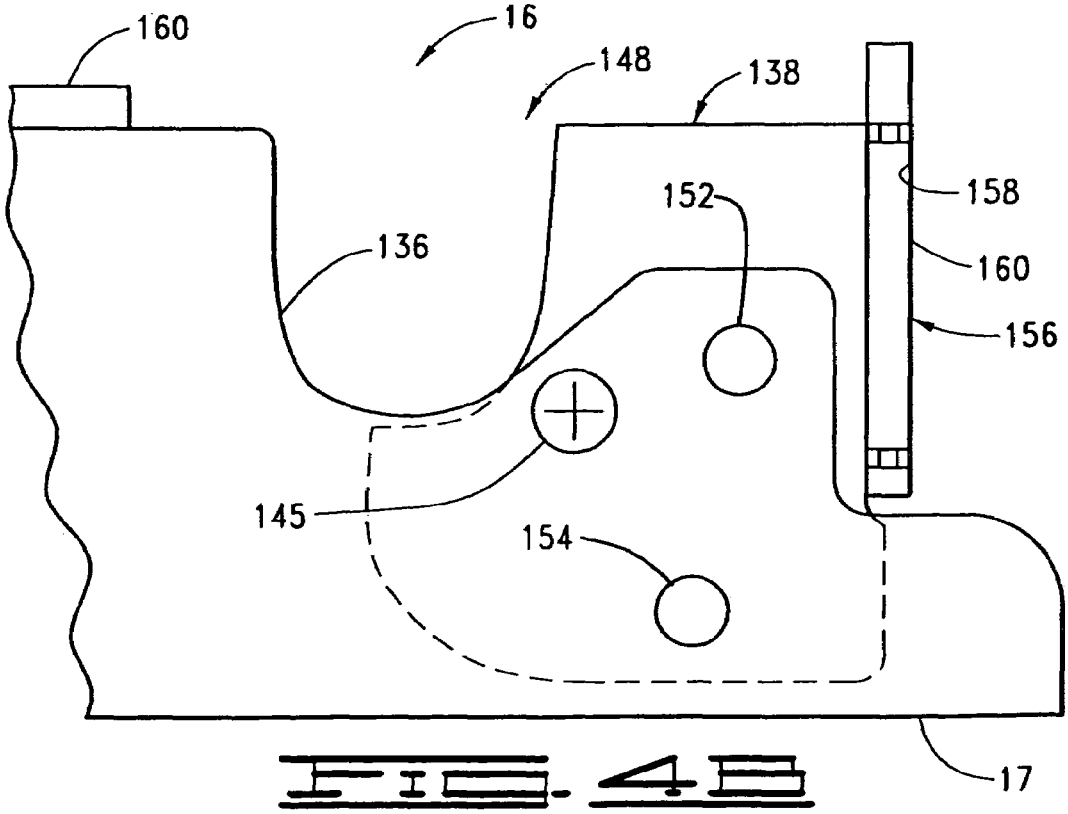
FIG. 4*b* is a fragmented, end view of the auxiliary pipe receiving assembly with the lockout system in the open position.

FIGS. 4*a*, 4*b* and 5 illustrate a preferred embodiment of the lockout system 138 operatively connectable to the pipe receiving chamber 136. In one preferred embodiment, the lockout system 138 is pivotally connectable to the pipe receiving chamber 136 by a pivot pin 145. The lockout system 138 pivots about the pivot pin 145 between a closed position 146 and an open position 148. More preferably, the lockout system 138 comprises a pin 150 to be inserted through a closed position pin hole 152 or an open position pine hole 154 to lock the lockout system in the respective positions. Alternative structures for operating the lockout system 138 are anticipated. For example, rather than pivoting the lockout system 138 onto the pipe receiving chamber 136 the lockout system may slide laterally between the closed position 146 and the open position 148. In the preferred embodiment, the lockout system 138 comprises an auxiliary blocking member 156. The auxiliary blocking member 156 has an auxiliary oversurface 158 that contacts with the pipe sections 20 when the lockout system 138 is in the closed position 146. The auxiliary oversurface 158 blocks the pipe sections 20 from entering the pipe receiving chamber 136. Additionally, the auxiliary oversurface 158 has a wear protection coating 160 to prevent excessive wear of the auxiliary oversurface.

With continued reference to FIGS. 2–5, in the preferred embodiment when the lockout system 138 is in the closed position 146, as shown in FIG. 4*a*, the lockout system blocks the pipe receiving chamber 136 and prevents a pipe section 20 from entering the receiving chamber during normal operation. As long as the lockout system 138 is in the closed position 146 it will block the column of pipe 54 at any time it is positioned under that column. In the closed position 146, the lockout system 138 presents a functionally continuous surface with the oversurface 128 of the pipe blocking member 126 of the pipe transfer members 17 when the lockout system is in the closed position 146. Thus, in the closed position 146, the lockout system 138 works in conjunction with pipe transfer member 17 such that the lockout system functions as the rear most part of the pipe handling assembly 14. Though the lockout system 138 is preferably at the rear of the pipe transfer member 17 to make it easier to add or remove a section of pipe 20, those skilled in the art will appreciate that it could be positioned at alternative locations along the pipe transfer members as discussed earlier.

With still continued reference to FIGS. 2–5, in the preferred embodiment, when the lockout system 138 is in the open position 148, the lockout system permits a pipe section 20 to be manually placed in the pipe receiving chamber 136. Though the auxiliary pipe receiving assembly 16 is shown to be only for one section of pipe 20, those skilled in the art will appreciate that the pipe receiving chamber 136 could be the width of more than one column 54. This would provide for more than one pipe 20 to be added or removed at a time.

It may be noted that in the preferred embodiment, when adding or removing a pipe section 20, the pipe transfer members 17 are typically fully retracted away from the spindle axis 24. Though it is only necessary to retract them just beyond the magazine 12. To add pipe, an operator manually moves the lockout system 138 from the closed position 146 in FIG. 4*a* to the open position 148 as shown in FIG. 4*b*. This is typically done by removing the pin 150 from the closed position hole 152, and rotating the lockout system 138 from the closed position 146 to the open position 148 position and inserting the pin 150 in hole 154. Though this is stated as a manual operation to position the lockout system 138, other mechanisms could be used such as a hydraulic cylinder. Once the lockout system 138 is in the open position 148 of FIG. 4*b*, an operator can manually places one section of pipe 20 into the pipe receiving chamber 136. At that point the pipe 20 would be supported on the pipe transfer members 17.

To align the pipe section 20 with the magazine 12 in the preferred embodiment, as illustrated in FIGS. 1 and 2, an axial stop 162 may be used as illustrated in FIGS. 1 and 2. This is preferably attached to the magazine 12 or a magazine mounting frame 28. The axial stop 162 is provided as a mechanical guide for properly aligning the pipe section 20 in the pipe receiving chamber 136 axially with the magazine 12. In the preferred embodiment, the axial stop 162 is mechanical and is either removable or hinged 170 (FIG. 1) to allow it to move out of the way when not in use. Preferably, when a pipe section 20 is in the pipe receiving chamber 136 and properly aligned with the magazine 12, the pipe transfer members 17 can be moved so that the auxiliary pipe receiving assembly 16 is positioned beneath a column 54 in which the pipe section is to be added.

A pipe return assembly 172 or a vertical lift, shown in FIGS. 1 and 6, can then be raised, lifting the pipe section 20 from the pipe receiving chamber 136 of the auxiliary pipe receiving assembly 16 into the magazine 12. This step can be repeated as many times as desired to fill column 54. The pipe transfer members 17 can then be retracted and the lockout system 138 closed so that the pipe handling assembly 14 can resume normal operation with a pipe section 20 now added to the magazine 12. That is, the pipe transfer member 17 employing the pipe holding member 15, will transport a pipe section 20 from the magazine 12 to the spindle axis 24. The above steps may be repeated until the desired number of additional pipe sections 20 are transported from the magazine 12 to the spindle axis 24 for addition to the drill string 131.

In the preferred embodiment, when receiving a pipe section 20 from the horizontal boring machine 18, the pipe transfer members 17 are advanced in direction X (FIG. 2) to the spindle axis 24. As the pipe transfer members 17 advance, the spring loaded pipe retainer 110 is deflected downward as it contacts the pipe section 20. The pipe holding member 15 is aligned with the pipe section 20 to be received. After alignment with the pipe section 20, the spring 112 returns the pipe retainer 110 to the support position and retains the pipe section in the pipe holding member 15 during transport. The pipe section 20 is unthreaded from the drill string 131 and is supported solely by the pipe holding member 15. The pipe transfer members 17 are then retracted in direction Y for return of the pipe section 20 to the magazine 12. Pipe sections 20 are replaced in the magazine 12 in a manner yet to be described.

It may be noted that when returning a pipe section 20 to the magazine 12, the operator will employ the following procedure. If additional pipe sections 20 were added to the drill string 131 during the boring process, then the additional pipe sections are added to and removed from the magazine 12 prior to filling up the magazine. To do this, a selected column 54 in the magazine 12 is used to add the additional pipe sections 20 removed from the drill string 131. Preferably, the selected column 54, is the last column that is farthermost from the spindle axis 24 and that is not completely full of pipe sections 20. The auxiliary pipe receiving assembly 16 is then employed to remove the pipe sections 20 from the magazine 12 to the auxiliary pipe receiving area 22 in a manner yet to be described.

After the additional pipe sections 20 have been removed from the magazine 12, then the following procedure is employed. When returning a pipe section 20 to the magazine 12, the column 54 that is farthermost from the spindle axis 24 that is not completely full of pipe sections is selected to store the pipe sections 20 removed from the drill string 131 until the column is full. Thereafter, pipe sections 20 will be stored in the immediately adjacent column 54 until it also is full. Addition of pipe sections 20 to the magazine will continue in this order until all columns 54 are full or until the backreaming is completed.

Turning now to FIGS. 6 and 7, the pipe return assembly 172 for returning pipe sections 20 to the magazine 12 is positioned beneath the lower portion 52 of the magazine 12 and comprises return arms 176, pivot pins 178, a link 180 and a hydraulic cylinder 182. The return arms 176 are attached to the frame 28 by pivot pins 178 and the link 180 connects the hydraulic cylinder 182 to the return arms 176 by pins.

The hydraulic cylinder 182 is actuated to extend the link 180 in a direction P. Extension of the link 180 in direction P shifts the return arms 176 thus raising the pipe section 20 into the selected column 54. Actuation of the hydraulic cylinder 182 causes the link 180 to move in direction P. As the link 180 is extended, the return arms 176 shift position causing the uppermost portion of the return arm to raise. Pipe section 20 supported on the return arms 176 is lifted into the selected column 54. After moving the pipe transfer member 17, the hydraulic cylinder 182 is then retracted causing link 180 to move in a direction Q. As the link 180 moves in direction Q, the return arms 176 lower. The pipe section 20 in the magazine 12 then rests directly on the pipe transfer members 17. The pipe transfer members 17 may then be extended to the spindle axis 24 to receive another pipe section 20 from the horizontal boring machine 18. This sequence is repeated until the pipe sections 20 from the drill string 131 of the horizontal boring machine 18 are returned to the magazine 12 and the magazine becomes full.

Alternatively, there may yet be other situations in which the operator may require only a single pipe section 20 or a small number of pipe sections to be removed from the drill string 131. In these situations, the operator will use either an empty magazine 12 or a near empty magazine to temporarily store the pipe section 20 prior to transporting the pipe section to the auxiliary pipe receiving area 22. Preferably, only a single magazine column 54 farthermost from the spindle axis 24 is used to temporarily store the pipe section 20 after it is removed from the drill string 131. The removed pipe section 20 is then transported from the magazine column 54 to the auxiliary pipe receiving area 22 by the auxiliary pipe receiving assembly 16 as follows.

A pipe section 20 is removed from the drill string 131 and transported from the spindle axis 24 to a selected magazine column 54 using the pipe holding member 15. After the pipe section 20 is added to the selected magazine column 54 by the pipe return assembly 172, the auxiliary pipe receiving assembly 16, after being placed in the open position as shown in FIG. 4*b*, will transport the pipe sections 20 from the magazine position 142, wherein the auxiliary pipe receiving assembly is aligned with the discharge opening 95 of the farthermost magazine column 54, from the spindle axis 24 to the auxiliary position 144. In the auxiliary position 144, the auxiliary pipe receiving assembly 16 is at the auxiliary pipe receiving area 22 from where the pipe section 20 may be manually or otherwise unloaded from the pipe receiving chamber 136 as discussed briefly earlier. The pipe receiving chamber 136 is then returned to be positioned under the discharge opening 95 of the farthermost magazine column 54 from the spindle axis 24. The above process is then repeated until the desired number of pipe sections 20 are removed from the drill string 131.

It will now be appreciated that the present invention permits loading and unloading of pipe sections 20 between a horizontal boring machine 18 and the magazine 12 of the pipe handling device 10 to makeup/breakout the drill string 131 and permits loading and unloading of additional pipe sections from an auxiliary pipe receiving area. The additional pipe sections 20 are transported in a generally horizontal position and in ready alignment with the horizontal boring machine 18 for immediate connection with the drill string 131.

Although the present invention has been described with respect to a several specific preferred embodiments thereof, various changes and modifications may be suggested to one skilled in the art, and it is intended that the present invention encompass such changes and modifications as fall within the scope of the appended claims.

What is claimed:

1. A pipe handling assembly for use with a horizontal boring machine, and a magazine comprising an outer border remote from a spindle axis of the horizontal boring machine, and a lower portion having a discharge outlet formed therein, wherein the pipe handling assembly comprises:

a pipe transfer member comprising a primary pipe receiving assembly adapted to transport a pipe section between the spindle axis and the discharge outlet of the magazine; and an auxiliary pipe receiving assembly operatively connectable to the transfer member and adapted to transport a pipe section between the discharge outlet of the magazine and an auxiliary area beyond the outer border of the magazine.

2. The pipe handling assembly of claim 1 wherein the magazine further comprises a plurality of columns within each of which a plurality of pipe sections may be received and stored.

3. The pipe handling assembly of claim 1 wherein the pipe transfer member further comprises a pipe blocking member between a first end and a second end of the pipe transfer member so that the pipe blocking member contacts with the pipe sections at the lower portion of the magazine and selectively blocks discharge of the pipe sections from the magazine.

4. The pipe handling assembly of claim 3 wherein the oversurface of the blocking member comprises a wear protection coating.

5. The pipe handling assembly of claim 1 wherein the auxiliary pipe receiving assembly comprises a pipe receiving chamber operatively connectable to the pipe transfer member and adapted to receive and support the pipe section.

6. The pipe handling assembly of claim 5 wherein the pipe receiving chamber of the auxiliary pipe receiving assembly is positionable in a magazine position wherein the auxiliary pipe receiving assembly is situated under the discharge outlet of the magazine to load and unload the pipe section to and from the magazine.

7. The pipe handling assembly of claim 6 wherein the pipe receiving chamber of the auxiliary pipe receiving assembly is positionable in an auxiliary position wherein the auxiliary pipe receiving assembly is situated beyond the outer border of the magazine from the spindle axis to load and unload the pipe section to and from the auxiliary area.

8. The pipe handling assembly of claim 1 wherein the auxiliary pipe receiving assembly further comprises:

a pipe receiving chamber operatively connectable to the transfer member and adapted to receive and support the pipe section;

a lockout system operatively connectable to the pipe receiving chamber and adapted to operate between an open position and a closed position;

wherein in the open position the lockout system will permit the pipe receiving chamber to receive and support a pipe section; and wherein in the closed position the lockout system will block the pipe receiving chamber so that the pipe receiving chamber is unable to receive and support the pipe section.

9. The pipe handling assembly of claim 8 wherein the lockout system is pivotally connectable to the pipe receiving chamber of the auxiliary pipe receiving assembly.

10. The pipe handling assembly of claim 8 wherein the lockout system comprises an auxiliary blocking member that contacts with the pipe sections when the lockout system is in the closed position and blocks the pipe sections from entering the pipe receiving chamber.

11. The pipe handling assembly of claim 10 wherein the auxiliary blocking member comprises a wear protection coating.

12. The pipe handling assembly of claim 10 wherein the pipe transfer member comprises a pipe blocking member adapted to form a functionally continuous surface with the auxiliary blocking member when the lockout system is in the closed position.

13. The pipe handling assembly of claim 6 further comprising an axial stop operatively connectable to the magazine and adapted to provide a mechanical guide for properly aligning the pipe section in the pipe receiving chamber with the discharge outlet of the magazine.

14. The pipe handling assembly of claim 6 further comprising an axial stop operatively connectable to a magazine frame and adapted to provide a mechanical guide for properly aligning the pipe section in the pipe receiving chamber with the discharge outlet of the magazine.

15. The pipe handling assembly of claim 1 wherein the magazine is supportable adjacent a spindle of the boring machine such that the pipe sections stored therein are generally parallel to the spindle axis.

16. The pipe handling assembly of claim 1 wherein the primary pipe receiving assembly of the pipe transfer member further comprises a pipe holding member that is structurally linked to the pipe transfer member.

17. The pipe handling assembly of claim 16 wherein the pipe holding member receives the pipe section transported from the auxiliary area to the discharge outlet of the magazine by the auxiliary pipe receiving assembly in order for the pipe section to be transported from beyond the outer border of the magazine to the spindle axis.

18. The pipe handling assembly of claim 17 wherein the pipe holding member is adapted to return the pipe section from the spindle axis to the discharge outlet of the magazine in order for the auxiliary pipe receiving assembly to transport the pipe section from the discharge outlet of the magazine to the auxiliary area.

19. The pipe handling assembly of claim 5 further comprising:

a rotation member;

a hydraulic motor operatively connectable to the rotation member; and at least one gear assembly operatively connectable to the rotation member to drive movement of the pipe transfer member; and wherein the pipe receiving chamber on the pipe transfer member is movable on a delivery path between the discharge outlet of the magazine and the auxiliary area.

20. The pipe handling assembly of claim 19 wherein the gear assembly comprises a rack and pinion gear.

21. The pipe handling assembly of claim 20 wherein the gear assembly is rotatably movable to drive movement of the pipe receiving chamber on the pipe transfer member between the discharge outlet of the magazine and the auxiliary area.

22. The pipe handling assembly of claim 19 wherein the delivery path of the pipe receiving chamber comprises at least one straight line segment.

23. The pipe handling assembly of claim 1 wherein the pipe transfer member is planar.

24. The pipe handling assembly of claim 1 wherein the pipe transfer member is arcuate.

25. The pipe handling assembly of claim 1 wherein the auxiliary pipe receiving assembly is operatively connectable to the pipe transfer member at a second end of the pipe transfer member.

26. The pipe handling assembly of claim 1 wherein the auxiliary pipe receiving assembly is operatively connectable to the pipe transfer member between a first end and a second end of the pipe transfer member.

27. A horizontal boring machine system to operate a variable length drill string comprising a plurality of pipe sections, the horizontal boring machine system comprising:

a boring machine having a spindle defining a spindle axis; and a pipe handling assembly adapted to add and remove pipe sections from the drill string, the pipe handling assembly comprising:

a magazine defining an outer border remote from the spindle axis having at least one discharge opening through which the pipe sections are released;

a pipe transfer member comprising a primary pipe receiving assembly adapted to transport a pipe section between the spindle axis and the discharge opening of the magazine; and an auxiliary pipe receiving assembly operatively connectable to the pipe transfer member and adapted to transport a pipe section between the discharge opening of the magazine and an auxiliary area beyond the outer border of the magazine.

28. The pipe handling assembly of claim 27 wherein the transfer member is planar.

29. The pipe handling assembly of claim 27 wherein the transfer member is arcuate.

30. The pipe handling assembly of claim 27 wherein the auxiliary pipe receiving assembly is operatively connectable to the pipe transfer member at the second end of the pipe transfer member.

31. The pipe handling assembly of claim 27 wherein the auxiliary pipe receiving assembly is operatively connectable to the pipe transfer member between a first end and a second end of the pipe transfer member.

32. The pipe handling assembly of claim 27 wherein the-pipe transfer member of the pipe handling assembly further comprises a pipe blocking member adapted to contact the pipe section at the discharge outlet of the magazine and selectively block the discharge of the pipe sections from the magazine.

33. The pipe handling assembly of claim 27 wherein the pipe transfer member of the pipe handling assembly further comprises a pipe blocking member adapted to contact the pipe section at the discharge outlet of the magazine and selectively block the discharge of the pipe section from the magazine.

34. The pipe handling assembly of claim 27 wherein the auxiliary pipe receiving assembly comprises a pipe receiving chamber operatively connectable to the transfer member of the pipe handling assembly and adapted to receive and support the pipe section.

35. The pipe handling assembly of claim 34 wherein the pipe receiving chamber of the auxiliary pipe receiving assembly is positionable under the discharge opening of the magazine to load and unload the pipe section to and from the magazine.

36. The pipe handling assembly of claim 34 wherein the pipe receiving chamber of the auxiliary pipe receiving assembly is positionable beyond the outer border of the magazine to load and unload the pipe section to and from the horizontal boring machine.

37. The pipe handling assembly of claim 27 wherein the auxiliary pipe receiving assembly further comprises:

a pipe receiving chamber operatively connectable to the pipe transfer member and adapted to receive and support the pipe section;

a lockout system operatively connectable to the pipe receiving chamber and adapted to operate between an open position and a closed position;

wherein in the open position the lockout system will permit the pipe receiving chamber to receive and support a pipe section; and wherein in the closed position the lockout system will block the pipe receiving chamber so that the pipe receiving chamber is unable to receive and support the pipe section.

38. The pipe handling assembly of claim 37 wherein the lockout system comprises an auxiliary blocking member adapted to contact the pipe section when the lockout system is in the closed position and blocks the pipe section from entering the pipe receiving chamber.

39. The pipe handling assembly of claim 38 wherein the pipe transfer member comprises a pipe blocking member, wherein the auxiliary blocking member forms a functionally continuous blocking surface with the pipe blocking member when the lockout system is in the closed position.

40. The pipe handling assembly of claim 35 further comprising an axial stop operatively connectable to the magazine and adapted to provide a mechanical guide for properly aligning the pipe section in the pipe receiving chamber with the discharge opening of the magazine.

41. The pipe handling assembly of claim 35 further comprising an axial stop operatively connectable to a magazine frame and adapted to provide a mechanical guide for properly aligning the pipe section in the pipe receiving chamber with the discharge opening of the magazine.

42. The pipe handling assembly of claim 27 wherein the pipe transfer member receives the pipe section from the magazine after the pipe section is transported to the magazine from the auxiliary area by the auxiliary pipe receiving member in order to transport the pipe section from beyond the outer border of the magazine to the spindle axis.

43. The pipe handling assembly of claim 27 wherein the pipe holding member returns the pipe section from the spindle axis to the magazine in order for the auxiliary pipe receiving member to transport the pipe section from the magazine to the auxiliary pipe receiving area.

44. A method for adding pipe sections to makeup a drill string composed of a plurality of pipe sections, using a horizontal boring machine with a spindle axis, and a pipe handling assembly with a pipe transfer member, to form a horizontal borehole, the method comprising:

transporting a pipe section to a magazine of the pipe handling assembly from an auxiliary pipe receiving area beyond an outer border of the magazine remote from the spindle axis, with an auxiliary pipe receiving assembly operatively connectable to the pipe transfer member; and transporting the pipe section from the magazine to the spindle axis using a pipe holding member operatively connectable to the pipe transfer member.

45. A method for removing pipe sections to breakout a drill string composed of a plurality of pipe sections using a horizontal boring system comprising a horizontal boring machine with a spindle axis, and a pipe handling assembly with a pipe transfer member, the method comprising:

transporting a pipe section removed from the drill string at the spindle axis to a selected magazine column of the pipe handling assembly by a pipe holding member operatively connectable to the pipe transfer member proximate to the spindle axis; and transporting the removed pipe section from the selected magazine column to an auxiliary pipe receiving area beyond an outer border of the magazine remote from the spindle axis using an auxiliary pipe receiving assembly operatively connectable to the pipe transfer member.

* * * * *